US006462719B1

(12) United States Patent
Ogino

(10) Patent No.: US 6,462,719 B1
(45) Date of Patent: Oct. 8, 2002

(54) DUPLEXER AND ANTENNA APPARATUS USING THE SAME

(75) Inventor: Tooru Ogino, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/747,938

(22) Filed: Dec. 27, 2000

(30) Foreign Application Priority Data

Dec. 28, 1999 (JP) ..... 11-374369

(51) Int. Cl.[7] ..... H01Q 9/30; H01Q 15/02; H01P 1/213

(52) U.S. Cl. ..... 343/900; 343/909; 333/134

(58) Field of Search ..... 343/900, 895, 343/909, 756, 873, 700 MS; 333/134, 202, 206, 222, 129

(56) References Cited

U.S. PATENT DOCUMENTS 5,708,448 A * 1/1998 Wallace ..... 343/895
5,712,648 A * 1/1998 Tsujiguchi ..... 333/134
6,008,707 A 12/1999 Tada et al. ..... 333/134
6,201,456 B1 * 3/2001 Hiratsuka
6,249,195 B1 * 6/2001 Mikami
6,249,255 B1 * 6/2001 Eggleston ..... 343/702
6,313,797 B1 * 11/2001 Kurita et al. ..... 343/700 MS

FOREIGN PATENT DOCUMENTS

| | | |
|---|---|---|
| JP | 05-327319 | 12/1993 |
| JP | 08-213835 | 8/1996 |
| JP | 11-312907 | 11/1999 |

* cited by examiner

*Primary Examiner*—Don Wong
*Assistant Examiner*—Chuc Tran
(74) *Attorney, Agent, or Firm*—McGinn & Gibb, PLLC

(57) ABSTRACT

A duplexer 24 comprising substantially semi-cylindrical filters 1 and 5 is disposed in and made integral with an increased diameter hollow stem part 29 of a substantially rod-like antenna element 22. The two filters 1 and 5 are coupled together by a coupler substrate 8 interposed between them. The coupler substrate 8 is disposed between the two filters 1 and 5 for forming a connector 23, which is connected to the antenna element 22. This assembly is connected by connector pieces 25 to 27 to a transmitter and a receiver part of a radio part of a portable telephone set or the like.

13 Claims, 3 Drawing Sheets

DUPLEXER AND ANTENNA APPARATUS USING THE SAME

BACKGROUND OF THE INVENTION

This application claims benefit of Japanese Patent Application No. 11-374369 filed on Dec. 28, 1999, the contents of which are incorporated by the reference.

The present invention relates to duplexers and antenna apparatus using the same and, more particularly, to a antenna apparatus, which is constituted by an antenna part and a duplexer part and can be suitably used as portable telephone set or like mobile communication system for transmitting and receiving signals to and from a common antenna.

Recent rapid progress trend of introducing and dealing with computers and various data in our society is leading to pronounced spread of mobile communication, such as portable and vehicle-mounted telephone, systems. Also, as mobile communication antenna, various types have been proposed. As prior art antenna system examples, Japanese Patent Laid-Open No. 5-327319 discloses "Antenna Duplexer", Japanese Patent Laid-Open No. 8-213835 discloses "Two-Frequency Common Antenna", and Japanese Patent Laid-Open No. 11-312907 discloses "Matching Circuit Chip, Filter with Matching Circuit, Hybrid Antenna-duplexer System and Mobile Communication System".

A prior art antenna apparatus will now be described with reference to FIG. 3. The illustrated antenna apparatus comprises an antenna element or whip antenna 30, an antenna element connector part 31, an antenna element connector piece 32, a duplexer output part 33, a duplexer receiver input part 34, a duplexer transmitter input part 35, a duplexer 36, a radio part substrate 37, a high frequency matching capacitor 38 and a high frequency matching coil 39.

The relation between whip antenna and duplexer of a portable telephone set or the like is just like the relation between the whip antenna 30 and the duplexer 36. Specifically, the whip antenna 30 as antenna element is supported by a mold or like of the portable telephone set, and its high frequency electrode part 31 as its connector part is electrically coupled to the duplexer 36 by its connector piece 32, which is soldered to the radio part substrate 37. The connector piece 32 is connected to an antenna side terminal of the duplexer 36 by a high frequency strip or like provided on the substrate 37. The circuit of the duplexer 36 is formed by connecting the transmitter and receiver input parts (or terminals) 35 and 34 to a transmitter and a receiver part, respectively, of the substrate 37.

The duplexer 36 occupies a predetermined area on the radio part substrate 37 despite demands for its size and weight reduction. In addition, the whip antenna 30 has such a shape that a wasteful inner space is formed in the frame of the portable telephone set. Furthermore, since the duplexer 36 is mounted on the substrate 37, the whip antenna 30 and the duplexer 36, which are both 50 ohms in their characteristic impedance, are interconnected by a connector strip line or the like, and thus require the chip capacitor 38 and the chip coil 39 for their high frequency matching.

In still further aspect, as next era portable telephone system a W-CDMA system has been adopted. This communication system is a simultaneous transmission/reception system, and should always use a duplexer. The transmission/reception frequency band used in this system is 2 GHz and extremely high. Although the duplexer used has been considerably reduced, in view of its mounting in the portable telephone set the size reduction is insufficient to meet recently rapidly escalating demand for portable telephone set size reduction. That is, the insufficient size reduction of the duplexer that is herefore available is an undesired factor from the potable telephone size reduction standpoint.

SUMMARY OF THE INVENTION

An object of the present invention is to provide a duplexer and an antenna apparatus using the same, which can be reduced in size sufficiently to suit portable telephone sets now escalating in size reduction and nevertheless ensure various required electric properties.

According to an aspect of the present invention, there is provided a duplexer comprising a transmitter side dielectric filter having a semi-cylindrical shape, a receiver side dielectric filter having a semi-cylindrical shape, and a substrate interposed between axially sectional surfaces of the two dielectric filters facing each other, the two dielectric filters having output parts thereof connected to a connector, which is connected to an antenna.

The transmitter and receiver dielectric filters each have axial holes.

According to another aspect of the present invention, there is provided an antenna apparatus comprising an antenna part having an end part, in which the above duplexer is disposed.

According to other aspect of the present invention, there is provided an antenna apparatus comprising an antenna part having an end part defining an inner space, in which the above duplexer is disposed.

According to further aspect of the present invention, there is provided an antenna apparatus for transmitting and receiving transmission and reception signals by using a substantially rod-like antenna element, wherein: the antenna element has a hollow stem part; and a transmitter side filter and a receiver side filter both having a substantially semi-cylindrical shape are disposed in the stem part of the antenna element such as to constitute a duplexer.

According to still other aspect of the present invention, there is provided an antenna apparatus for transmitting and receiving transmission and reception signals by using a substantially rod-like antenna element, wherein: the antenna element has a hollow stem part; a transmitter side filter and a receiver side filter both having a substantially semi-cylindrical shape are disposed in the stem part of the antenna element such as to constitute a duplexer; and the substantially semi-cylindrical transmitter and receiver side filters are coupled together via a coupler substrate interposed therebetween.

The antenna element and the duplexer are interconnected by a connector provided on the coupler substrate. Input and output parts formed on outer surfaces of the transmitter and receiver side filters are connected by a plurality of connector pieces to a transmitter and a receiver part of a radio part of a portable telephone set or the like. The antenna element has a tip part greater in diameter than the remainder.

Other objects and features will be clarified from the following description with reference to attached drawings.

PREFERRED EMBODIMENTS OF THE INVENTION

Preferred embodiments of the present invention will now be described with reference to the drawings.

Figure 1:
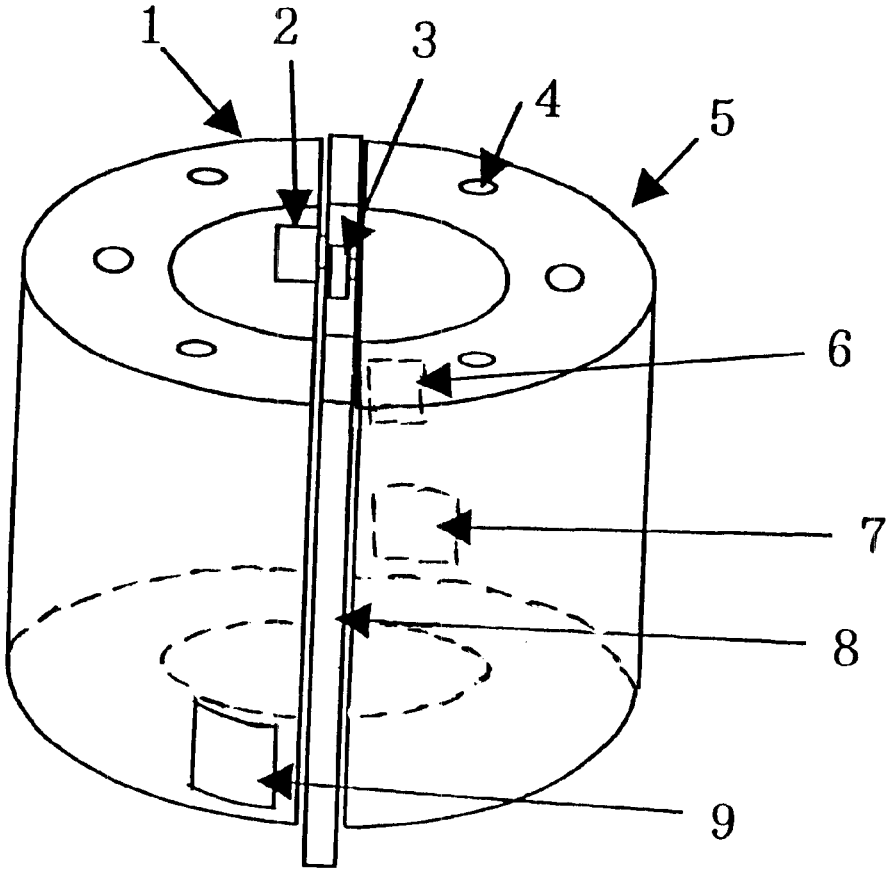
FIG. 1 is a perspective view showing a duplexer used in a preferred embodiment of antenna apparatus according to the present invention.

FIG. 1 is a perspective view showing a duplexer used in a preferred embodiment of antenna apparatus according to the present invention. Referring to the Figure, the illustrated antenna apparatus comprises a transmitter side dielectric filter 1, a transmitter side dielectric filter output part 2, a connector 3 for connection to the antenna e dielectric filter resonation holes 4, a receiver side dielectric filter 5, a receiver side dielectric filter output part 6, a receiver side dielectric filter input part 7, a dielectric filter coupler substrate 8 and a transmitter side dielectric filter input part 9.

The transmitter side dielectric filter 1, unlike the shape of the usual duplexer, is semi-cylindrical. The dielectric filter is connected by the transmitter side dielectric filter input part 9 to the radio transmitter side, and its output is provided from its output part 2. The dielectric filter 1 has the high frequency resonation holes 4. The receiver side dielectric filter 5, likewise, is connected by the receiver side dielectric filter input part 7 to the radio receiver side, and its output is provided from its output part 6. The output parts 2 and 6 of the dielectric filters 1 and 5 are electrically connected by the connector 3 to the substrate 8, which is provided between the two dielectric filters. The connector 3 provides the duplexer output, and constitutes the juncture of connection to the antenna. The overall structure as described above constitutes the duplexer and is substantially cylindrical as a whole. The substantially cylindrical duplexer is formed in this shape for the purpose of making it to be integral with the antenna.

Unlike the prior art duplexer, which is block-like in shape and is mounted on the radio substrate as described above, the duplexer for the antenna apparatus according to the present invention has the structural feature that it is cylindrical in shape. The prior art duplexer comprises two filters, which are coupled together and shares frequency bands of waves on the transmitter and receiver sides. The two filters are connected to a single antenna. The duplexer thus requires three terminals, and therefore it has a block-like shape. Such block-like duplexer should be mounted on a radio substrate, and also requires a chip capacitor and a chip coil for high frequency matching with the antenna, which is subsequently connected.

Figure 2:
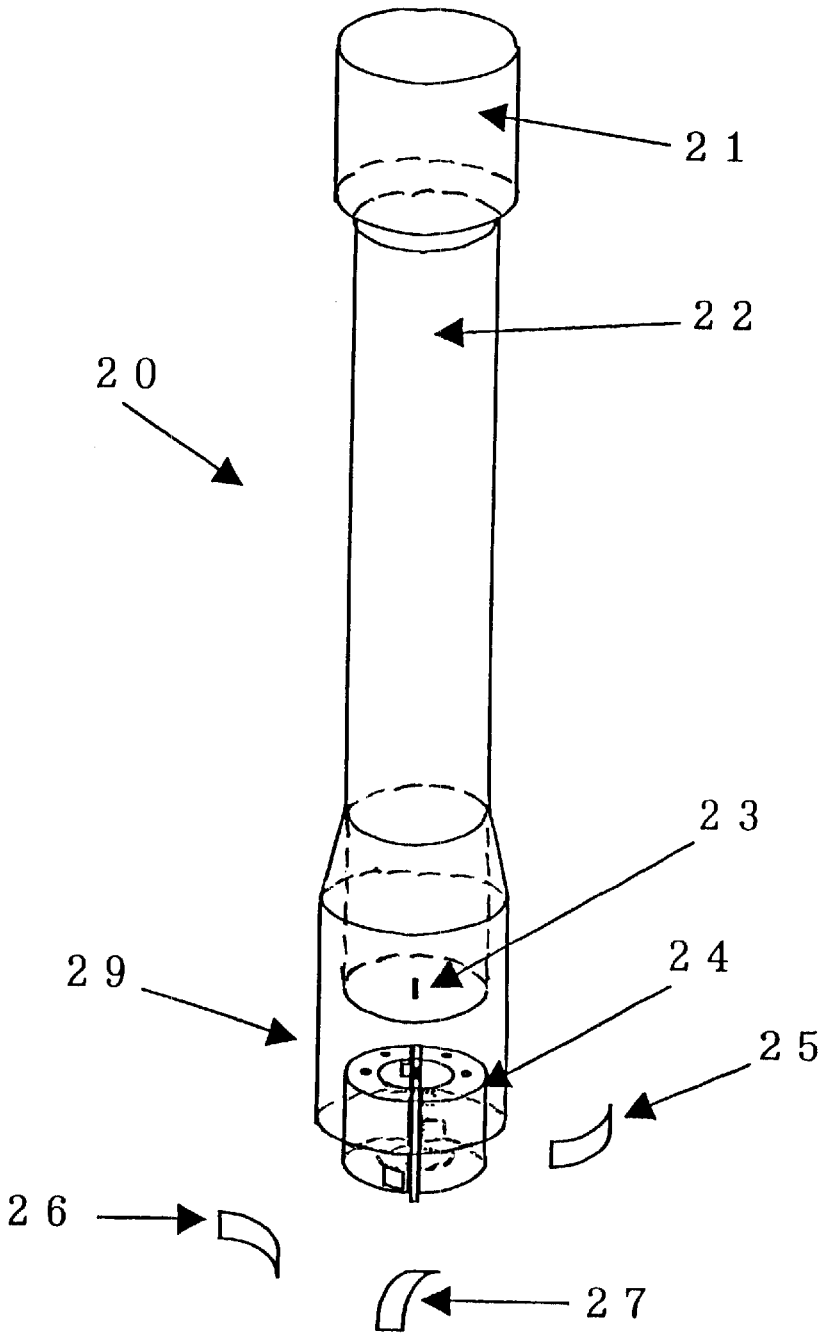
FIG. 2 is a perspective view showing the preferred embodiment of antenna apparatus according to the present invention.
Figure 3:
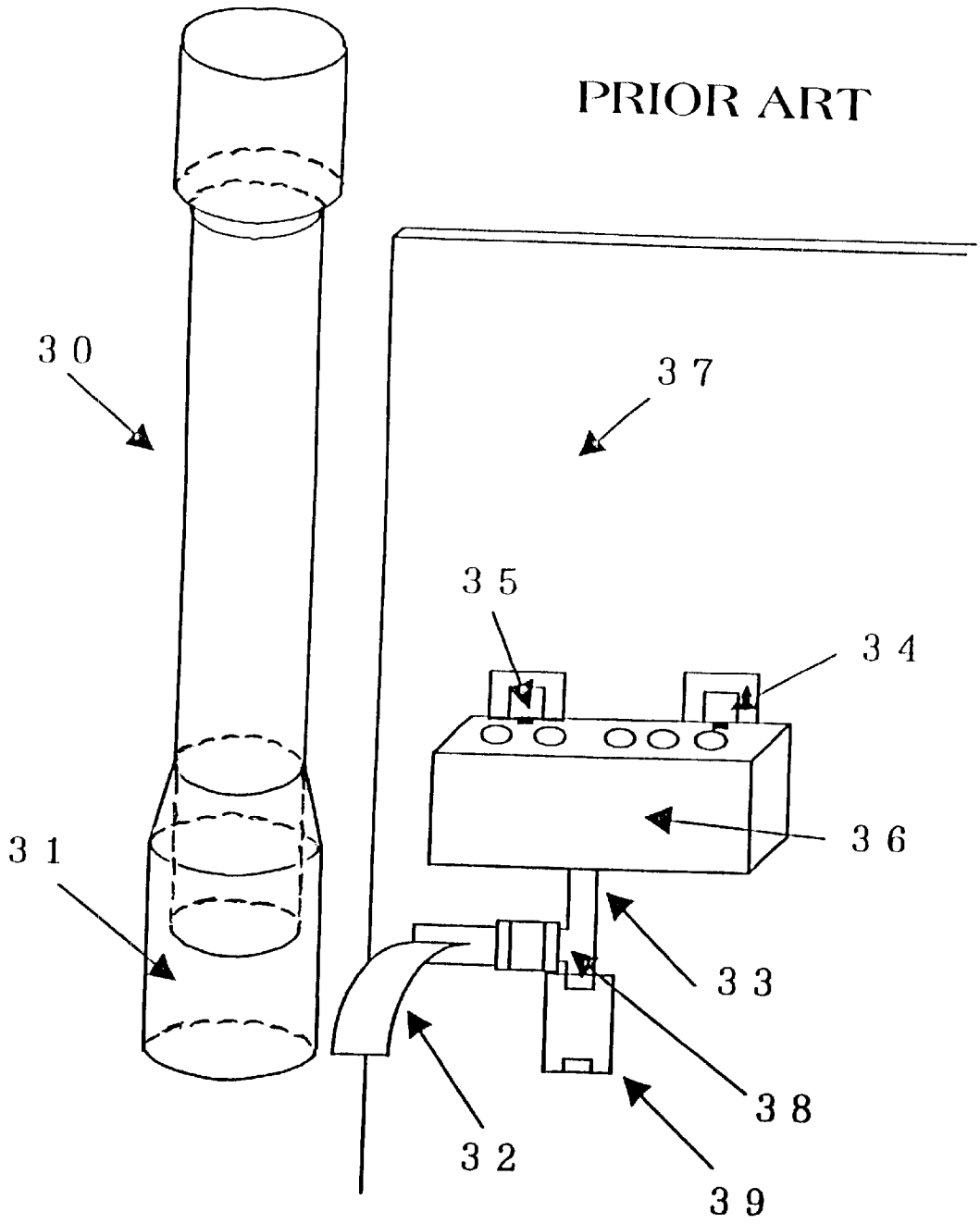
FIG. 3 is a perspective view showing a prior art antenna apparatus.

FIG. 2 is a perspective view showing the preferred embodiment of antenna apparatus according to the present invention. The illustrated antenna apparatus comprises a whip antenna element 22, a juncture 23 as connector, a duplexer 24 and connector pieces 25 to 27. The whip antenna element 22 is rod-like with a small diameter as a whole, and has relatively large diameter end parts as a tip and a stem part 21 and 29, respectively.

The duplexer 24 is the one described before in connection to FIG. 1. The duplexer 24 is disposed in the stem part 29 of the whip antenna element 22. The duplexer 24 and the antenna element 22 interconnected at the juncture 23. The connector pieces 26 and 25 are connected to the transmitter and receiver sides, respectively, of the ratio part. It will be seen that the antenna apparatus 20 as a whole has a characteristic of duplexer, and is connected to the radio part.

The operation of the preferred embodiment of antenna apparatus as shown in FIGS. 1 and 2 will now be described. As best shown in FIG. 2, high frequency signal from the radio transmitter part (not shown), is coupled via the connector piece 26 to the antenna element 22. The duplexer 24 comprising the high frequency dielectric filter is provided in the antenna element 22 and is connected to the connector part 26. Likewise, the radio receiver part (not shown), is connected via the connector piece 25 to the duplexer 24. The output of the duplexer 24 is coupled to the antenna element 22, and the whole antenna serves as duplexer.

The operation of the duplexer 24 provided in the antenna element 22 will now be described. The transmitter side dielectric filter 1 is the same in material and shape of the resonating part as the usual block type electric filter. However, the filter 1 is actually semi-cylindrical or substantially semi-cylindrical in shape. The receiver side dielectric filter 5 has the same shape. The filter coupler substrate 8 is disposed between and couples together the transmitter and receiver side dielectric filters 1 and 5, which can thus operate together as duplexer.

The preferred embodiment of duplexer and antenna apparatus using the same according to the present invention has been described in connection with its construction and operation. This embodiment, however, is merely exemplary and has no sense of limiting the present invention, and a person skilled in the art will readily understand that various changes and modifications of the embodiment may be made for specific purposes without departing from the scope and spirit of the present invention.

As has been made obvious from the above description and the drawings, the duplexer and the antenna apparatus using the same according to the present invention permits a small size antenna apparatus to be obtained by integrating the duplexer and the antenna element. Specifically, it is possible to save substrate area and space of mounting of the duplexer and the antenna element. In addition, since the receiver and transmitter sides of the ratio part are directly coupled of the antenna element, by setting the impedance, for instance 50 ohms no impedance matching element need be added, which has a pronounced practical effect that it is possible to further reduce size and price of the assembly while ensuring satisfactory electric characteristics.

What is claimed is:

1. A duplexer comprising a transmitter side dielectric filter having a semi-cylindrical shape, a receiver side dielectric filter having a semi-cylindrical shape, and a substrate interposed between axially sectional surfaces of the two dielectric filters facing each other, the two dielectric filters having output parts thereof connected to a connector, which is connected to an antenna.

2. The duplexer according to claim 1, wherein the transmitter and receiver dielectric filters each have axial holes.

3. An antenna apparatus for transmitting and receiving transmission and reception signals by using a substantially rod-like antenna element, wherein:

the antenna element has a hollow stem part; and a transmitter side filter and a receiver side filter both having a substantially semi-cylindrical shape are disposed in the stem part of the antenna element such as to constitute a duplexer.

4. The antenna apparatus according to claim 3, wherein input and output parts formed on outer surfaces of the transmitter and receiver side filters are connected by a plurality of connector pieces to a transmitter and a receiver part of a radio part of a portable telephone set or the like.

5. The antenna apparatus according to claim 3, wherein the antenna element has a tip part greater in diameter than the remainder.

6. An antenna apparatus for transmitting and receiving transmission and reception signals by using a substantially rod-like antenna element, wherein:

the antenna element has a hollow stem part;

a transmitter side filter and a receiver side filter both having a substantially semi-cylindrical shape are disposed in the stem part of the antenna element such as to constitute s a duplexer; and the substantially semi-cylindrical transmitter and receiver side filters are coupled together via a coupler substrate interposed therebetween.

7. The antenna apparatus according to claim 6, wherein the antenna element and the duplexer are interconnected by a connector provided on the coupler substrate.

8. The antenna apparatus according to claim 6, wherein input and output parts formed on outer surfaces of the transmitter and receiver side filter are connected by a plurality of connector pieces to a transmitter and a receiver part of a part of a portable telephone set or the like.

9. The antenna apparatus according to claim 6, wherein the antenna element has a tip part greater in diameter than the reminder.

10. An antenna apparatus comprising:

an antenna part having an end part with a duplexer, said duplexer including:

a transmitter side dielectric filter having a semi-cylindrical shape;

a receiver side electric filter having a semi-cylindrical shape;

and a substrate interposed between axially sectional surfaces of the two dielectric filter facing each other, the two dielectric filters having output parts thereof connected to a connector, which is connected to an antenna.

11. The apparatus of claim 10, wherein the end part defines an inner space in which the duplexer is disposed.

12. An antenna apparatus comprising:

an antenna part having an end part with a duplexer,said duplexer including:

a transmitter side dielectric filter having a semi-cylindrical shape;

a receiver side dielectric filter having a semi-cylindrical shape;

and a substrate interposed between axially sectional surfaces of the two dielectric filters facing each other,the two dielectric filters having output parts thereof connected to a connector,which is connected to an antenna,wherein the transmitter and receiver dielectric filters each have axial holes.

13. The apparatus of claim 12, wherein the end part defines an inner space in which the duplexer is disposed.

* * * * *